US007578082B2

(12) United States Patent
Sans Rovira et al.

(10) Patent No.: US 7,578,082 B2
(45) Date of Patent: Aug. 25, 2009

(54) ROLLER IRONING MACHINE FOR ARTICLES OF CLOTHING

(75) Inventors: Ramon Sans Rovira, Vic (ES); Carles Riba Romeva, Sant Joan Despi (ES); Pere Girbau Pous, Vic (ES)

(73) Assignee: Girbau S.A., Vic (Barcelona) (ES)

( * ) Notice: Subject to any disclaimer, the term of this patent is extended or adjusted under 35 U.S.C. 154(b) by 103 days.

(21) Appl. No.: 10/586,411

(22) PCT Filed: Jan. 19, 2004

(86) PCT No.: PCT/ES2004/000019

§ 371 (c)(1),
(2), (4) Date: Apr. 2, 2007

(87) PCT Pub. No.: WO2005/068705

PCT Pub. Date: Jul. 28, 2005

(65) Prior Publication Data

US 2007/0277406 A1 Dec. 6, 2007

(51) Int. Cl.
*D06F 67/10* (2006.01)
*D06F 63/00* (2006.01)

(52) U.S. Cl. ..... 38/44; 38/45

(58) Field of Classification Search ..... 38/44–62; 425/363, 373; 34/119; 162/206, 358.5
See application file for complete search history.

(56) References Cited

U.S. PATENT DOCUMENTS 897,859 A * 9/1908 Brockardt ..... 38/9
1,415,262 A 5/1922 Norrie
2,599,486 A * 6/1952 Werner ..... 26/1
3,110,612 A * 11/1963 Gottwald et al. ..... 427/362
3,557,665 A 1/1971 Von Lowis
3,559,262 A 2/1971 Glenn et al.
3,799,052 A * 3/1974 Kusters et al. ..... 100/313
3,851,414 A * 12/1974 Miculka et al. ..... 38/49

(Continued)

FOREIGN PATENT DOCUMENTS

EP 0 367 017 A1 5/1990

(Continued)

OTHER PUBLICATIONS

International Search Report for PCT International Application No. PCT/ES 2004/000019 mailed May 7, 2004.

*Primary Examiner*—Ismael Izaguirre
(74) *Attorney, Agent, or Firm*—RatnerPrestia

(57) ABSTRACT

A roller ironing machine for articles of clothing includes a heated ironing roller supported, guided and rotated in a frame, a floating pressure roller parallel to and in contact with the ironing roller and endless belts mounted to satellite rollers to cover part of the ironing roller. Additionally, axial journals belonging to the floating pressure roller rest against inclined planes which are fixed to the frame such as to form an angle in relation to a plane that is tangent to the ironing roller and the floating pressure roller on the line of mutual contact. The journals rest against the planes with a force that includes a normal component derived from the weight of the roller, thereby producing a greater ironing force than the weight of the roller owing to the wedge effect provided by the opposing directions of rotation of the ironing roller and the floating pressure roller.

14 Claims, 4 Drawing Sheets

U.S. PATENT DOCUMENTS

| | | | | | |
|---|---|---|---|---|---|
| 4,434,566 | A | * | 3/1984 | Krauss et al. | 38/8 |
| 4,781,795 | A | * | 11/1988 | Miller | 162/358.5 |
| 4,860,466 | A | * | 8/1989 | Vanderheyden | 38/8 |
| 4,877,487 | A | * | 10/1989 | Miller | 162/360.3 |
| 5,551,175 | A | | 9/1996 | Neyman | |
| 5,933,988 | A | | 8/1999 | Adler | |
| 2001/0015025 | A1 | | 8/2001 | Grandpierre et al. | |

FOREIGN PATENT DOCUMENTS

| | | | |
|---|---|---|---|
| EP | 0 528 745 | A2 | 2/1993 |
| EP | 0 856 603 | A2 | 8/1998 |
| ES | 398428 | | 9/1974 |
| ES | 8 702 963 | | 4/1987 |
| ES | 2 041 564 | | 11/1993 |
| ES | 2 185 955 | | 5/2003 |
| FR | 2 388 921 | | 11/1978 |

* cited by examiner

ROLLER IRONING MACHINE FOR ARTICLES OF CLOTHING

This application is a U.S. National Phase Application of PCT International Application No. PCT/ES2004/000019 filed Jan. 19, 2004.

SCOPE OF THE INVENTION

The present invention concerns a roller ironing machine for clothing articles of the type comprising at least one ironing roller fitted with heating means to heat its surface and at least one pressing roller, arranged parallel to said ironing roller and in contact with same, providing ironing pressure on the clothing articles that pass between the two.

TECHNICAL BACKGROUND

An ironing machine for ironing and drying clothing articles is known comprising at least one rotating roller facing a static ironing tray. The mentioned rotating roller is hollow and has cylindrical wall with multiple perforations, covered by springs and with an outer coating of flannelette, while the ironing tray presents a concave mirror-finished surface, heated from its outer face by heating means. The clothing articles are passed between the flannelette associated with the rotating roller and the polished, heated tray surface, and pulled along by the roller rotation and accompanied by flexible bands mounted on various satellite rollers. The mentioned springs arranged under the flannelette in the rotating roller covering provide an ironing pressure against the heated tray surface.

One drawback of this type of ironing machine is that the tray surface is difficult to heat uniformly because same is static. Thus, the heating means must incorporate, for example, some serpentines on the outer face of the tray and pumping means to circulate a fluid previously-heated by an energy source through said serpentines. The installation of the mentioned heating means is very costly and has negative repercussions on the final machine cost. Another drawback is that the surface of the tray has to be manufactured with very narrow dimensional tolerances and with final grinding and finishing that also involve high costs that add to the final machine cost.

Another type of ironing machine for clothing articles is also known comprising an ironing roller supported and guided in a rotating manner in a frame, with heating means arranged to heat its cylindrical surface, together with one or more pressing rollers arranged in a rotating manner on said frame in parallel to said ironing roller and in contact with same. A series of parallel endless bands are mounted on various satellite rollers of the ironing roller, which embrace an angular portion of the ironing roller to accompany the clothing articles maintaining them in contact with ironing roller. Driving means are included to rotate the ironing roller and/or the pressing roller or rollers and/or circulate said endless bands. The pressing roller or rollers are adapted to provide an ironing pressure on the clothing articles that pass between them and the ironing roller, which is achieved, either directly by the weight of the pressing roller, or with the assistance of thrusting devices, such as, for example, mechanisms based on elastic members or pneumatic cylinders etc.

Patents U.S. Pat. No. 3,557,665, 5,551,175, 5,933,988 and patent application US-A-2001/0015025 describe different examples of roller ironing machines in which at least one pressing roller provides an ironing pressure against the heated roller.

In this type of machine, the ironing pressure is only applied to the line of contact between the pressing roller and the ironing roller, so that this pressure must be considerably high in order to be efficient. One drawback is that, in order to achieve such efficient ironing pressure, the pressing roller has to be extremely heavy or has to be pushed by the mentioned thrusting devices, which complicates the machine and increases production costs. Moreover, in the case of employing the roller weight to provide the ironing pressure, the pressing roller position is limited to the upper part of the roller, with the ideal position being that in which the axes of both cylinders are in a vertical plane. This conditions the locations of the loading entrance and the unloading exit for the clothing articles with respect to the ironing roller, makes it difficult to arrange said entrance and exit on opposite sides of the ironing roller, which becomes a drawback when it is desired to connect two or more ironing units in series or an ironing unit with other laundry processing units for clothing articles.

DISCLOSURE OF THE INVENTION

The present invention is intended to overcome or mitigate the previous and other drawbacks providing a roller ironing machine for clothing articles comprising at least one ironing unit comprising, in combination: at least one ironing roller supported and guided in a rotating fashion on a frame, and fitted with heating means to heat its surface; at least one pressing roller arranged in a rotating manner on said frame, in parallel to said ironing roller and in contact with same, providing ironing pressure on clothing articles that pass between the two; at least one endless band mounted on several satellite rollers of the ironing roller and embracing an angular portion of the ironing roller to accompany the clothing articles maintaining them in contact with the ironing roller; driving means to rotate the ironing roller and/or circulate said endless bands, and a pair of first inclined planes for the or each pressing roller, mounted in a static manner on a frame and against which axial journals are supported extending from opposite ends of the corresponding pressing roller when same is in contact with the ironing roller. The mentioned first inclined planes form an angle with respect to an imaginary plane tangential to the ironing roller and the pressing roller in the line of mutual contact and are located in a manner so that said axial journals are supported against the first inclined planes through the effect of a force that includes at least one normal component derived from the weight of the pressing roller, resulting in an ironing force component exerted by the pressing roller on the ironing roller greater than said weight of the pressing roller and a wedge effect favoured by the opposite directions of rotation of the ironing and pressing rollers.

With this construction, the machine of the present invention achieves an efficient ironing pressure using the weight of the pressing roller from a pressing roller of moderate weight. This is thanks to the wedge effect, a force multiplier produced by the first inclined planes in relation to the ironing roller. Moreover, this force multiplier effect is greater the closer the inclined planes are to one end of the of the roller horizontal diameter, which is quite the opposite of what occurs with state of the art rollers that simply use weight, without inclined planes, in which the most favourable position is that is as close as possible to the upper end of the roller vertical diameter.

In the machine of this invention, the low pressing roller position favours the layout of a loading entrance for clothing articles at one side of the ironing roller and an unloading exit on the opposite side, which permits one or more ironing units to be connected in series, including a transfer device to transfer the clothing articles from the unloading exit of one of the ironing units to the loading entrance of another of the adjacent ironing units. Advantageously, in order to respond to a modular machine design, each of the ironing units may be mounted on an independent frame constituting independent modular units susceptible to being coupled together or with other laundry processing units for clothing articles.

A BRIEF DESCRIPTION OF THE DRAWINGS

The previous and other advantages and characteristics will be more fully understood from the following detailed description of exemplary embodiments, with reference to the attached drawings, in which.

DETAILED DESCRIPTIONS OF SOME EXEMPLARY EMBODIMENTS

Figure 1:
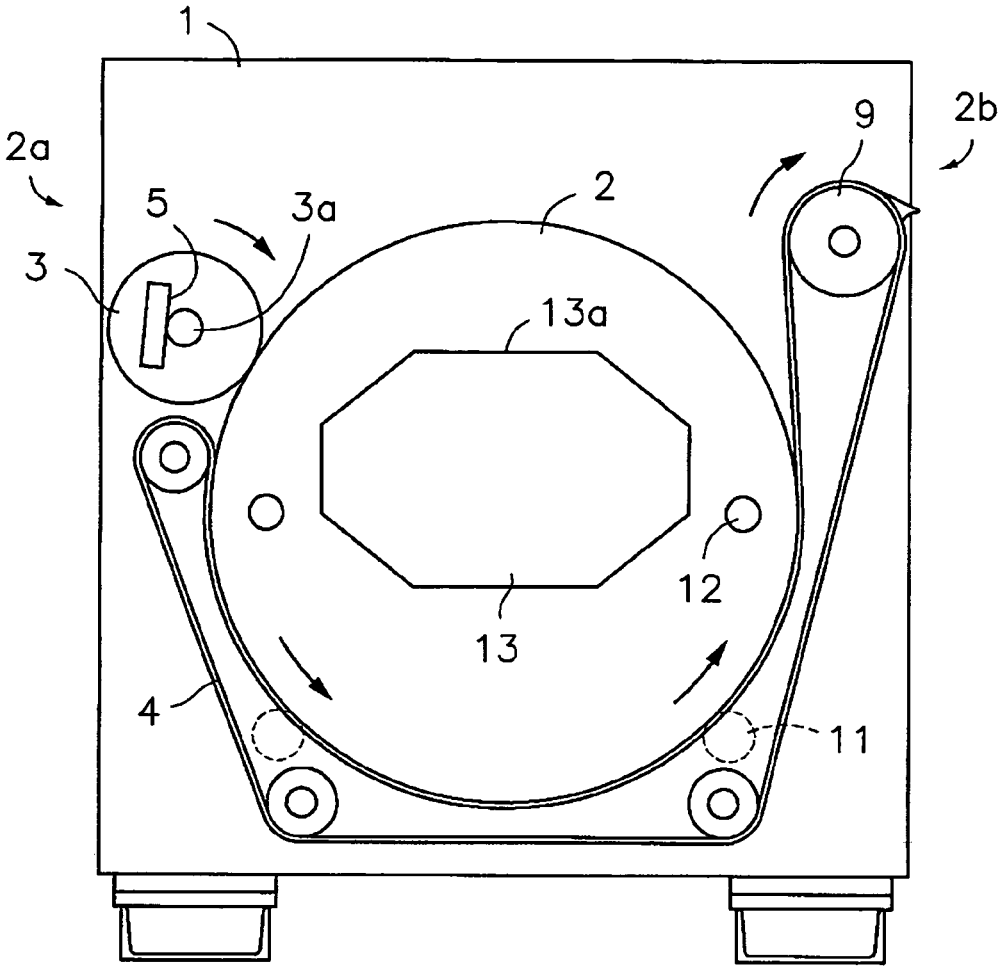
FIG. 1 is a lateral elevation schematic view of a roller ironing machine for clothing articles in accordance with an exemplary embodiment of the present invention.

First referring to FIG. 1, which shows an exemplary embodiment of the roller ironing machine for clothing articles in accordance with the present invention comprising an ironing unit comprising an ironing roller 2 supported and guided in a rotating manner on a frame 1. Thus, for example, two pairs of wheels 11 are mounted so that they are able to freely rotate on the frame 1 and the ironing roller 2 is supported by its ends on said pairs of wheels 11. Other known means could equally be employed to support and guide the ironing roller 2 in a rotating fashion.

Heating means are arranged inside the ironing roller 2 to heat its surface. Since the ironing roller constantly rotates, it is relatively simple to uniformly heat its outer surface from the inside by means of, for example, one of more rows of gas burners 12 located in static positions and an extractor device for the combustion gases that include a conduit 13 arranged inside the ironing roller 2 in an axial position, with a perforated upper wall 13*a* connected to an extractor turbine (not shown). Although gas has been shown to be an efficient energy source, other heating means employing other energy sources could equally be used with the machine of the present invention.

There is also a pressing roller 3 arranged on frame 1, which is parallel to the ironing roller 2 and in contact with same. The function of said pressing roller 3 is to provide ironing pressure for the clothing articles that pass between the ironing 2 and pressure 3 rollers and for this reason the pressing roller 3 has special characteristics that will be described later. Although the machine shown in FIG. 1 only incorporates a pressing roller 3, other execution variants are possible with two or more pressing rollers mounted in accordance with the present invention.

A plurality of parallel endless bands 4 are mounted on various satellite rollers arranged around the ironing roller 2, said endless bands embracing an angular portion of the ironing roller 2 to accompany the clothing articles maintaining them in contact with the ironing roller 2. Conventional driving means are arranged and connected to rotate the ironing roller 2 and/or to circulate said endless bands 4, while the pressing roller 3 is rotated by the ironing roller 2.

The machine incorporates for the, or each, pressing roller 3, a pair of first inclined planes 5, mounted on the frame 1 in a static manner, against which axial journals 3*a*, or rolling elements, extending from opposite ends of the corresponding pressing roller 3 are supported. Said first inclined planes 5 form an angle A with respect to an imaginary plane Pt tangential to the ironing roller 2 and the pressing roller 3 in the line of mutual contact and are located in a manner that, when the pressing roller 3 is in contact with the ironing roller 2. Said axial journals 3*a* are supported against the first inclined planes 5. In other words, the first inclined planes 5 and the outer surface of the ironing roller 2 form a type of wedge in which the pressing roller 3 wedges by gravity, the pressing roller 3 being arranged in a "floating" fashion on the frame 1, meaning it does not have a fixed position, but instead its position is adjusted to said wedge. To facilitate rotation of the pressing roller 3, the axial journals 3*a* incorporate rolling means, preferably incorporating ball bearings.

Figure 2A:
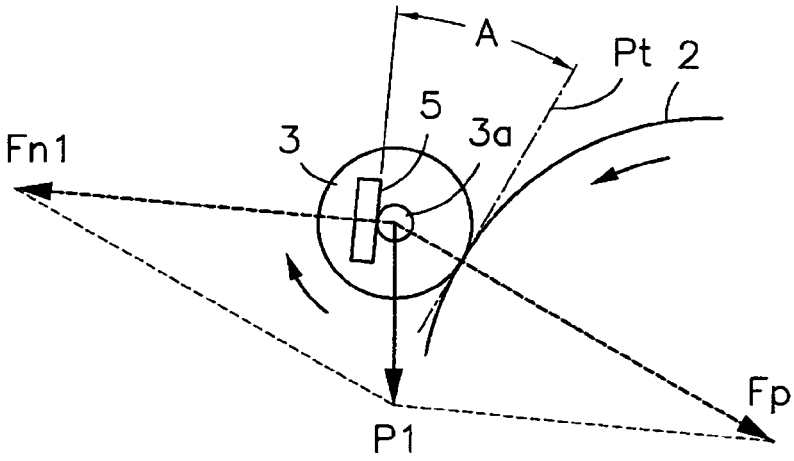
FIGS. 2A, 2B and 2C are diagrams illustrating the distribution of forces in the pressure device using first inclined planes in FIG. 1.
Figure 2B:
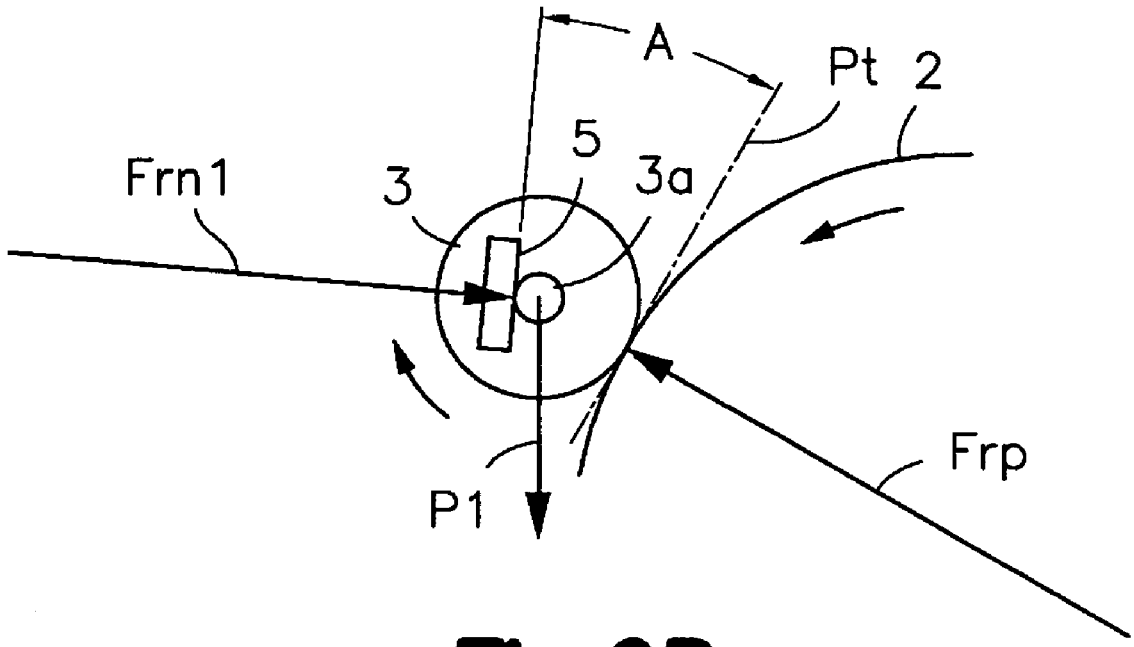
Figure 2C:
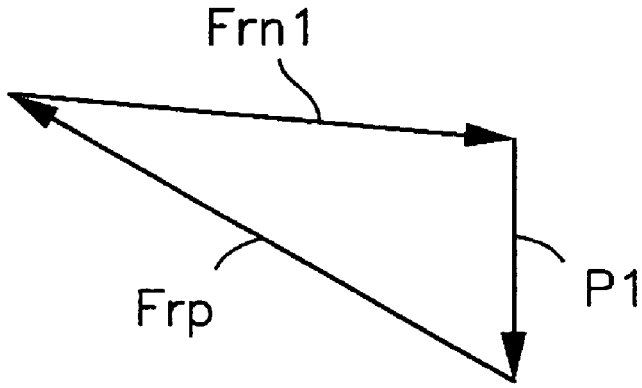

The mentioned wedge has a force multiplier effect multiplying the force with which the pressing roller 3 accommodates to the wedge, said force being, in this exemplary embodiment, exclusively the weight of the pressing roller 3. In FIGS. 2A, 2B and 2C, said wedge force multiplier effect is schematically illustrated by vector diagrams.

The diagram of FIG. 2A illustrates the decomposition of weight P of pressing roller 3 into a component Fn1 normal to the first inclined planes 5 and another component Fp normal to an imaginary plane Pt tangential to the ironing roller 2 and the pressing roller 3, which represents the ironing force component Fp exerted by the pressing roller 3 on the ironing roller 2. Note that, in function of the mentioned angle A between the inclined planes 5 and the imaginary plane Pt tangential to the ironing roller 2 and the pressing roller 3, the ironing force component Fp exerted by the pressing roller 3 on the ironing roller 2 can be considerably greater than the weight P1 of the pressing roller 3. Moreover, by providing the ironing roller 2 and the pressing roller 3 with opposite directions of rotation (indicated by arrows in the figures) directed towards the interior of the wedge, the ironing pressure is favoured.

The diagram of FIG. 2B shows how a reaction force Frn1 exerted by the inclined planes 5 on the journals 3*a* and a reaction force Frp exerted by the ironing roller 2 against the pressing roller 3 balance the weight P1 of the pressing roller 3. Such balance is more clearly illustrated by the force polygon shown in FIG. 2C. Evidently, the reaction force Frn1 exerted by the inclined planes 5 on the journals 3*a* is equal and of opposite sign to the normal force component Fn1 exerted by the journals 3*a* on the inclined planes 5, and the reaction force Frp exerted by the ironing roller 2 against the pressing roller 3 is equal and of opposite sign to the ironing force Fp exerted by the pressing roller 3 against the ironing roller 2.

The machine of the present invention can incorporate a regulating device (not shown) adapted to vary the mentioned inclination angle A of the first inclined planes 5 in order to regulate the cited ironing force component Fp in accordance with the desired ironing characteristics. Such a regulating device can be any type known in the state of the art, for example, providing a pivoting mounting for each inclined plane to pivot about an axis and a tightening wing-nut threaded to a stud attached to the frame and arranged to immobilise the inclined plane in a desired position.

Figure 3:
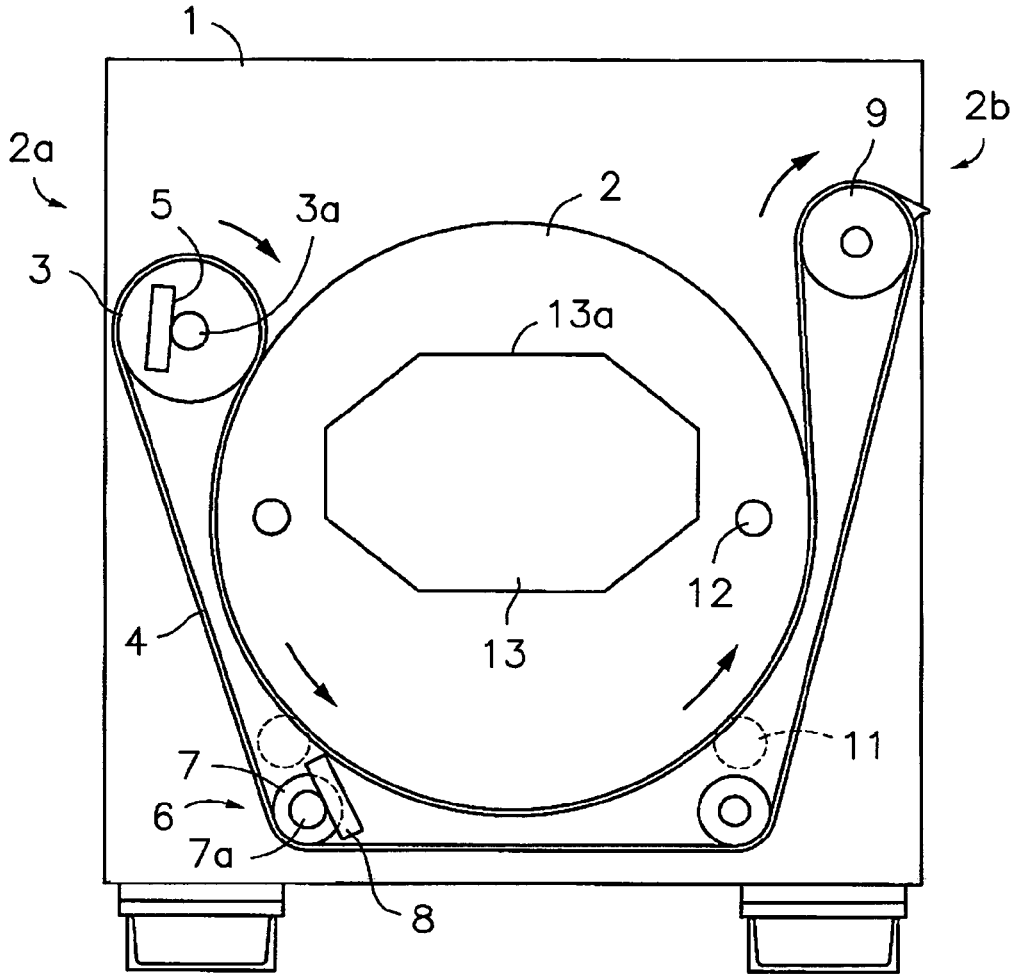
FIG. 3 is a lateral elevation schematic view of a roller ironing machine for clothing articles in accordance with another exemplary embodiment of the present invention.

Now referring to FIG. 3, this shows another exemplary embodiment of the ironing machine in accordance with the present invention in which the mentioned various satellite rollers on which the endless bands 4 are mounted, include the pressing roller 3. In other words, the endless bands 4 are supported and circulate on the pressing roller 3. The endless bands 4, in general, undergo a certain degree of tension T and, consequently, exert a force resulting from said tension T on the pressing roller 3, from which a normal force component is derived that is added to said normal force that produces the support of the axial journals 3*a* against the first inclined planes 5, where an ironing force component results exerted by the pressing roller 3 on the ironing roller 2 that is greater than the sum of the weight P1 of the pressing roller 3 and said force resulting from the tension T of the endless band 4. In other words, the force resulting from the tension T on the pressing roller 3 also undergoes multiplication derived from the wedge effect similar to that described above in relation to FIGS. 2A-2C.

Eventually, the machine of the present invention can include a thrusting device (not shown) applied to the pressing roller 3 in order to provide a pushing force from which force components are derived that are added to the force produced by the support of the axial journals 3*a* against the first inclined planes 5 and to the force produced by the pressing roller 3 against the ironing roller 2. The mentioned thrusting device may be any known type, such as, for example, a mechanism based on springs or other elastic members, weights, cylinders or other pneumatic or hydraulic actuators or combinations thereof.

Figure 4A:
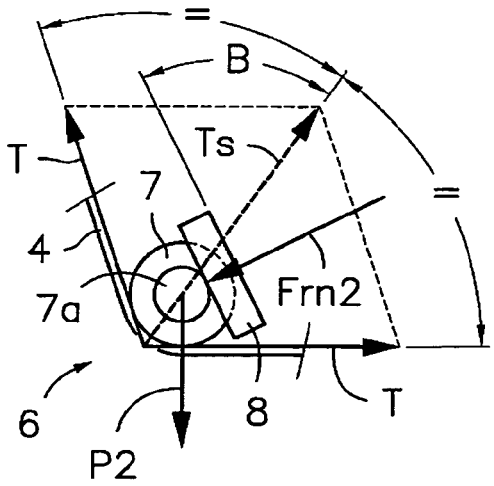
FIGS. 4A and 4B are diagrams illustrating the distribution of forces in the tensor device using second inclined planes in FIG. 3.
Figure 4B:
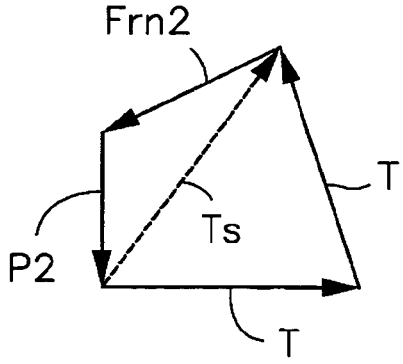

In the exemplary embodiment shown in FIG. 3, the machine comprises at least one tensor device 6 adapted to provide the cited tension T of the endless band 4. This tensor device may be of any well-known type in the technical field. The illustrated tensor device 6 comprises a tensing roller 7, included in said satellite rollers, and a pair of second inclined planes 8 mounted in a static manner on the frame 1, forming an angle B (also see FIG. 4A) with respect to the bisectrix of the angle formed by the sections of the endless band 4 adjacent to each side of said tensing roller 7, i.e. with respect to the direction of a force Ts resulting from the two components of tension T of the endless bands 4 on the tension roller 7. Axial journals 7*a*, or rolling elements, extending from opposite ends of the tension roller 7 are supported against said second inclined planes 8, which are located in such a manner so that the two components of tension T of the endless band 4 are automatically balanced with weight P2 of the tension roller 7 and a normal reaction force Frn2 exerted by the second inclined planes 8 on the axial journals 7*a* of the tension roller 7, as schematically illustrated by a polygon of forces in FIG. 4B.

In a similar fashion to that described above in relation to the first inclined planes 5, the machine of the present invention comprises a regulator device (not shown) adapted to vary the cited inclination angle B of the second inclined planes 8 in order to regulate the tension T of the endless band 4 in accordance with the desired tension characteristics. It is evident that the tension roller 7 may be any of the mentioned satellite rollers located around the ironing roller 2, and similarly a force in a direction moving away from the second inclined planes 8 could be employed provided by any known thrusting device in place of, or in addition to, the weight P2 of the tension roller 7.

As shown in FIGS. 1 and 3, the characteristic construction of the pressing roller 3 in the ironing unit in accordance with the present invention makes it easy to position the pressing roller 3 at an adequate height with respect to the ironing roller 2 facilitating loading of the clothing articles to be ironed through an entrance located on a first side 2*a* of the ironing roller 2 and an unloading of the ironed clothing articles through an exit located on a second side 2*b* of the ironing roller 2 opposite the first one. To this end, an unload roller 9 is located at an adequate height with respect to the ironing roller 2 to facilitate said unloading. In the illustrated exemplary embodiments, the mentioned unload roller 9 is included in said satellite rollers and is aided by belts (not shown) to separate the clothing articles from the ironing roller 2 and direct them towards the exit, in accordance with a conventional device. However, any other known unloading device is applicable to the machine of the invention.

Figure 5:
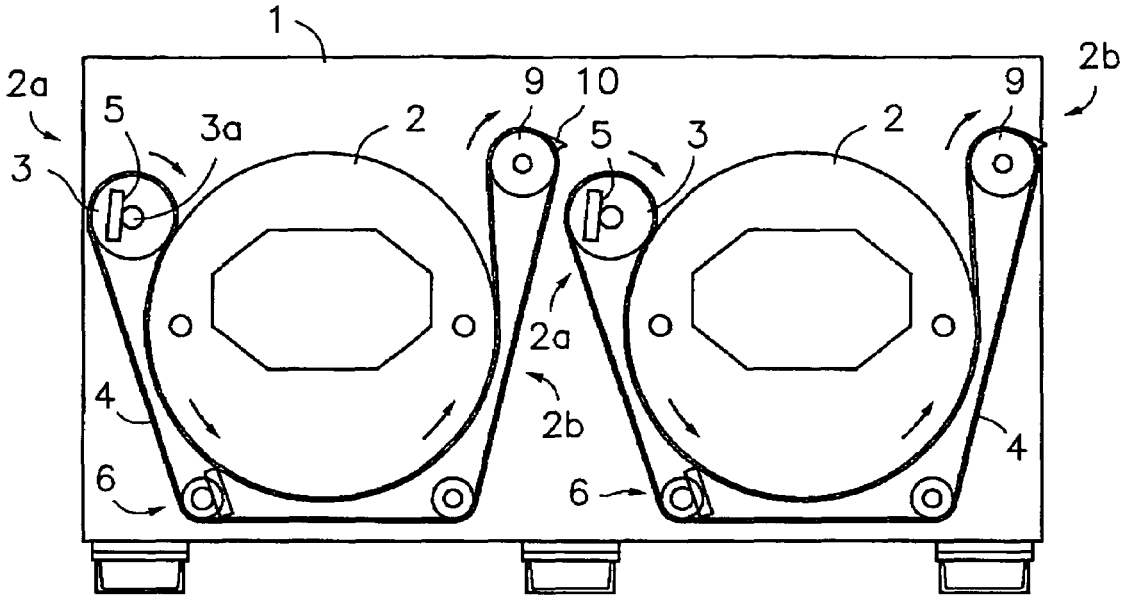
FIG. 5 is a lateral elevation schematic view of a roller ironing machine for clothing articles in accordance with the present invention including two ironing units connected in series.

Referring now to FIG. 5, it shows an exemplary embodiment of the ironing machine in accordance with the present invention that comprises two or more ironing units connected in series, including a transfer device 10 adapted to transfer clothing articles from the mentioned unload exit of one of the ironing units to the cited loading entrance of another adjacent ironing init. The cited transfer device 10 may be of any known type, preferably adapted to the characteristics of the employed unload roller 9. Connecting two or more ironing units in series is common in the sector of laundry processing clothing articles and is employed to optimise drying and ironing clothing articles through successive passes over the ironing surface.

Figure 6:
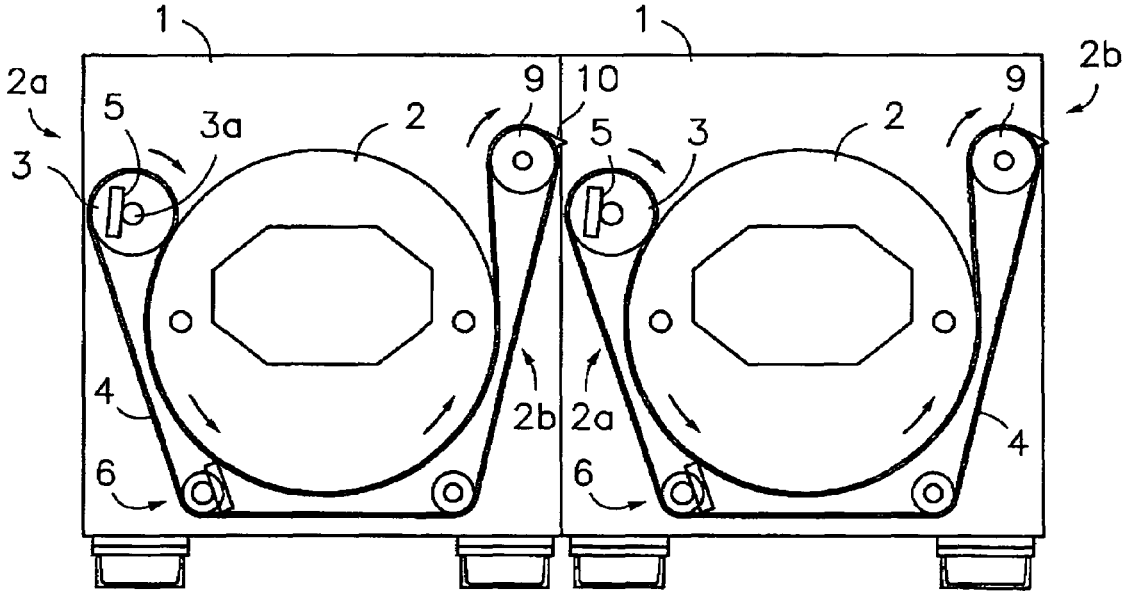
FIG. 6 is a lateral elevation schematic view of two modular ironing machine units in accordance with the present invention connected in series.

FIG. 6 shows a composition similar to that described in relation to FIG. 5, but in that each of the ironing units is mounted on an independent frame 1 constituting independent modular ironing units susceptible to be coupled together or with other laundry processing units for clothing articles. Here, each modular ironing machine unit preceding another processing unit includes a transfer device such as that described above.

Although the invention has been described using specific exemplary embodiments, those skilled in the art would be capable of numerous modifications, variations and/or inclusions in same without departing from the scope of the present invention as defined in the attached claims.

The invention claimed is:

1. A roller ironing machine for clothing articles, characterised in that it comprises at least one ironing unit comprising, in combination:

at least one ironing roller supported and guided to rotate about a fixed geometric axis on a frame and fitted with heating means to heat its surface;

at least one floating pressure roller arranged in a rotating fashion on said frame, said pressure roller being parallel to said ironing roller and in contact therewith providing an ironing pressure on the clothing articles that pass between the ironing roller and the floating pressure roller rotating in opposite directions;

at least one endless belt mounted on a plurality of satellite rollers placed around the ironing roller and gripping an angular portion of the ironing roller in order to accompany the clothing articles maintaining them in contact with the ironing roller;

drive means to rotate the ironing roller and/or circulate said endless belt; and a pair of first inclined planes mounted in a static manner on the frame and against which axial journals extending from opposite ends of the floating pressure roller or rolling elements installed on said axial journals are movably supported when the floating pressure roller, is in contact with the ironing roller;

wherein said first inclined planes form an angle with respect to an imaginary plane tangential to the ironing roller and the floating pressure roller along a line of mutual contact, said angle having a value and said inclined plains being located in a position with regard to said ironing roller axis so that the floating pressure roller is wedged by gravity between said first inclined planes and the ironing roller, and an ironing force component exerted by the floating pressure roller against the ironing roller derived from a weight of the floating pressure roller is greater than said weight of the floating pressure roller.

2. A roller ironing machine according to claim 1, wherein said satellite rollers on which said at least one endless belt is mounted include the floating pressure roller.

3. A roller ironing machine according to claim 2, wherein a force resulting from a tension of the endless belt is added to the weightiest of the floating pressure roller to provide an ironing force component exerted by the floating pressure roller on the ironing roller greater than the sum of said weight of the floating pressure roller and said force resulting from the tension of the endless belt.

4. A roller ironing machine according to claim 1, wherein force component provided by a thrusting device selected from a group consisting of at least one elastic member, one weight, one fluid dynamic cylinder or combinations thereof is applied to thrust the floating pressure roller against the first inclined planes and the ironing roller.

5. A roller ironing machine according to claim 1, further comprising a regulating device adapted to vary said angle of the first inclined planes with respect to said imaginary plane tangential to the ironing roller and the floating pressure roller along a line of mutual contact so as to regulate said ironing force component according to desired ironing characteristics.

6. A roller ironing machine according to claim 3, further comprising at least a tensor device adapted to provide said tension to the endless belt.

7. A roller ironing machine according to claim 6, wherein said tensor device comprises a tensing roller included in said satellite rollers, and a pair of second inclined planes amounted in a static manner on the frame and against which axial journals extending from opposite ends of the corresponding tensing roller or rolling elements installed on said axial journals are movably supported, where said second inclined planes are at an angle with respect to a bisecting line of an angle formed by adjacent lengths of the endless belt at each side of said tensing roller and placed in such a position that the tension of the endless belt is automatically balanced with a second force in a direction away from the second inclined planes applied by a thrusting device or by gravity on the tensing roller and a normal reaction force exerted by the second inclined planes against the axial journals or rolling elements of the tensing roller.

8. A roller ironing machine according to claim 7, wherein said second force is provided by gravity and corresponds to the weight of the tensing roller.

9. A roller ironing machine according to claim 7, wherein the machine further comprises a regulating device adapted to vary said inclination angle of the second inclined planes with respect to said bisecting line so as to regulate the tension of the endless belt according to the desired tension characteristics.

10. A roller ironing machine according to claim 1, wherein the floating pressure roller is placed at a predetermined height with respect to the ironing roller to facilitate loading of the clothing articles to be ironed through an entrance located at a first side of the ironing roller, and the machine comprises an unload roller located at a predetermined height with respect to the ironing roller to facilitate an unloading of the ironed clothing articles through an exit located at a second side of the ironing roller opposite the first side.

11. A roller ironing machine according to claim 10, wherein said unload roller is included in said satellite rollers.

12. A roller ironing machine according to claim 10, wherein the machine comprises two or more ironing units connected in series, including a transferring device adapted to transfer the clothing articles from said unloading exit of one of said ironing units to said loading entrance of another adjacent of the ironing units.

13. A roller ironing machine according to claim 12, wherein each of said ironing units is mounted on an independent frame forming modular units able to be coupled together or with other processing units for laundry clothing articles.

14. A roller ironing machine according to claim 2, wherein said force effecting the rest of the axial journals on the first inclined planes further includes a force component based on a thrusting device selected from a group consisting of at least one elastic member, one weight, one fluid dynamic cylinder or combinations thereof.

* * * * *